US008366490B2

(12) United States Patent
Wu

(10) Patent No.: US 8,366,490 B2
(45) Date of Patent: Feb. 5, 2013

(54) USB PLUG CABLE ASSEMBLY

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/237,983

(22) Filed: Sep. 21, 2011

(65) Prior Publication Data

US 2012/0071021 A1 Mar. 22, 2012

(30) Foreign Application Priority Data

Sep. 21, 2010 (CN) ..... 2010 1 0288967

(51) Int. Cl.
*H01R 24/00* (2011.01)

(52) U.S. Cl. ..... 439/660

(58) Field of Classification Search ..... 439/660, 439/607.46, 607.5, 607.51
See application file for complete search history.

(56) References Cited

U.S. PATENT DOCUMENTS 7,422,488 B1 * 9/2008 Wu ..... 439/676
7,494,381 B1 * 2/2009 Wu et al. ..... 439/630
7,625,236 B1 * 12/2009 Wu ..... 439/607.58
7,789,711 B2 * 9/2010 Wu ..... 439/640

* cited by examiner

*Primary Examiner* — Phuong Dinh
(74) *Attorney, Agent, or Firm* — Wei Te Chung; Ming Chieh Chang

(57) ABSTRACT

A cable assembly includes a plurality of contacts, an insulation housing and a metal shell assembled on the insulation housing. The insulation housing is molded outside the contacts and includes a fastening portion protruding from a rear end of an upper surface of the housing, and a pair of side arms rearward extending from the two sides of a rear surface of the fastening portion. The metal shell is assembled on the insulation housing and located behind the fastening portion. The fastening portion is substantially of U-shaped configuration with a pair of L-shaped cutout located on the two sides thereof and the two cutouts faces toward the outside. The metal shell includes a pair of clasping portions respectively frontward extending from the front surface of two side walls of the rectangular frame. The clasping portions are respectively inserted into their corresponding cutouts.

10 Claims, 7 Drawing Sheets

USB PLUG CABLE ASSEMBLY

FIELD OF THE INVENTION

The present invention generally relates to a USB plug cable assembly, and more particularly to a USB plug cable assembly with an improved shell.

DESCRIPTION OF RELATED ART

Universal Serial Bus (USB) is a serial bus standard to the PC architecture with a focus on computer telephony interface, consumer and productivity applications. The interface design of USB is standardized by the USB Implementers Forum (USB-IF), an industry standardized organization founded by computer and communication companies. And USB cables used to connect peripherals such as mouse devices, keyboards, PDAs, gametabs and joysticks, scanners, digital cameras, printers, external storage, networking components, etc. For many devices such as scanners and digital cameras, USB has become the standard connection method.

Most USB cable assemblies comprise a housing, a plurality of contacts assembled on the housing, a cable electrically connected to the contacts, a metal shell enclosing the housing, a cover assembled on the shell and surrounding the shell. In assembly, firstly the shell is assembled on the housing, and then the cover is attached on the outer surface of the shell. However, this assembling method make cable assembly have a big height so as not to fit for the need of present Correspondingly, it is desired to have a cable assembly with improved structure to address the problems stated above.

BRIEF SUMMARY OF THE INVENTION

Accordingly, an object of the present invention is to provide a cable assembly with low profile.

In order to achieve the above-mentioned object, the cable assembly comprises a plurality of contacts, an insulation housing and a metal shell assembled on the insulation housing. The insulation housing is molded outside the contacts and comprises a fastening portion protruding from a rear end of an upper surface of the housing, and a pair of side arms rearward extending from the two sides of a rear surface of the fastening portion. The metal shell is assembled on the insulation housing and located behind the fastening portion. The fastening portion is substantially of U-shaped configuration with a pair of L-shaped cutout located on the two sides thereof and the two cutouts faces toward the outside. The metal shell comprises a pair of clasping portions respectively frontward extending from the front surface of two side walls of the rectangular frame. The clasping portions are respectively inserted into their corresponding cutouts.

Other objects, advantages and novel features of the invention will become more apparent from the following detailed description of the present embodiment when taken in conjunction with the accompanying drawings.

DETAILED DESCRIPTION OF THE INVENTION

Figure 1:
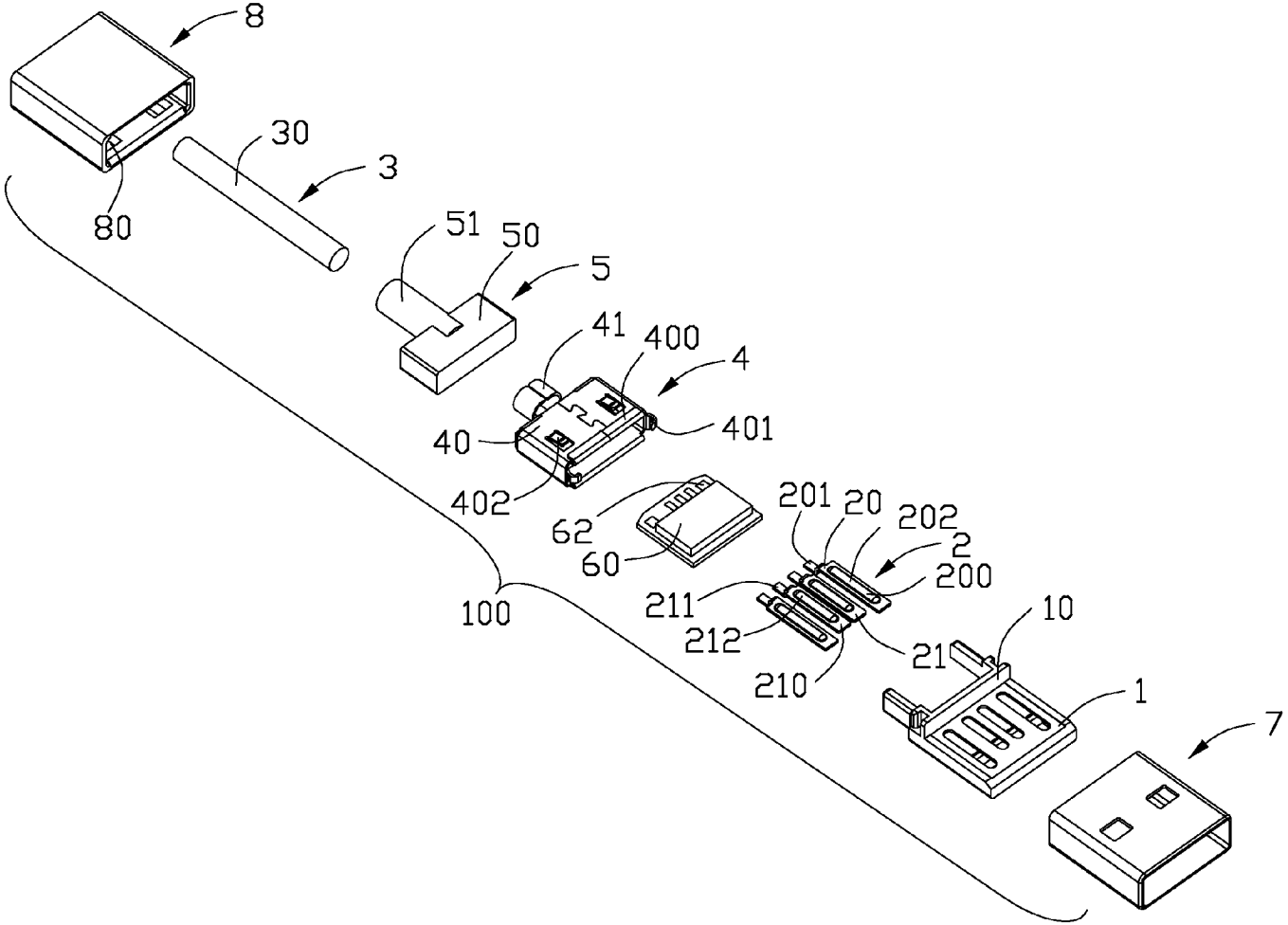
FIG. 1 is an exploded, perspective view of a cable assembly in accordance with the present invention.

Reference will now be made to the drawing figures to describe the present invention in detail.

Figure 2:
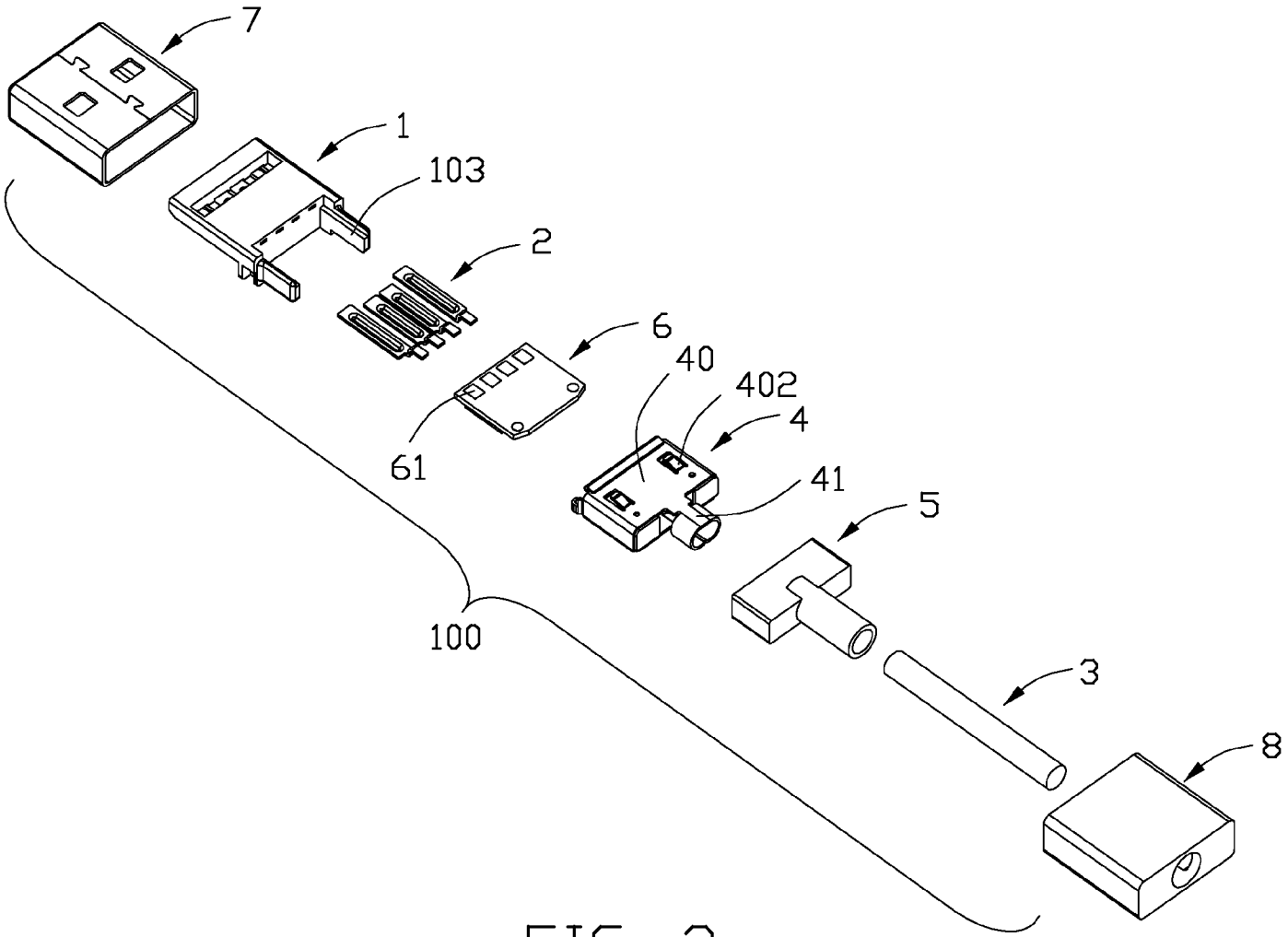
FIG. 2 is similar to FIG. 1, but viewed from another aspect.

Referring to FIGS. 1 to 2, a cable assembly 100 in accordance with the present invention comprises a plurality of contacts 2, an insulation housing 1 molded to surround the conducts 2, a cable 3 electrically connected to the contacts 2, a metal shell 4 assembled on the rear portion of the insulation housing 1, a front cover 7 covering the insulation housing 1 and a rear cover 8 covering the metal shell 4.

Figure 3:
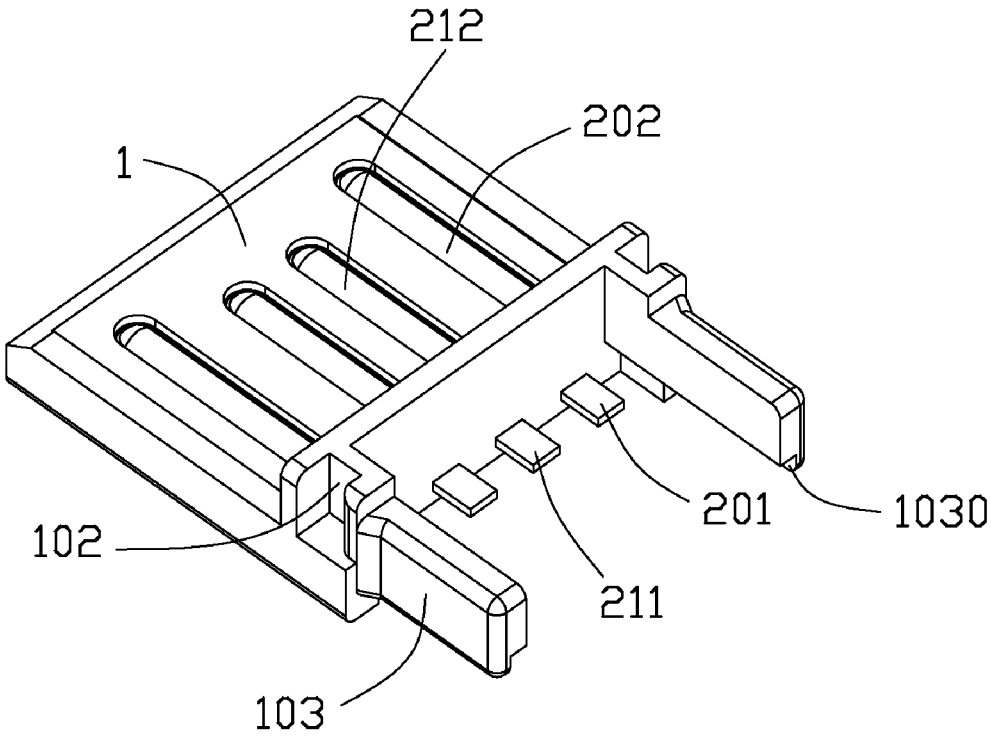
FIG. 3 is a perspective, partial assembled view of the housing and the contacts of the cable assembly of FIG. 1.
Figure 4:
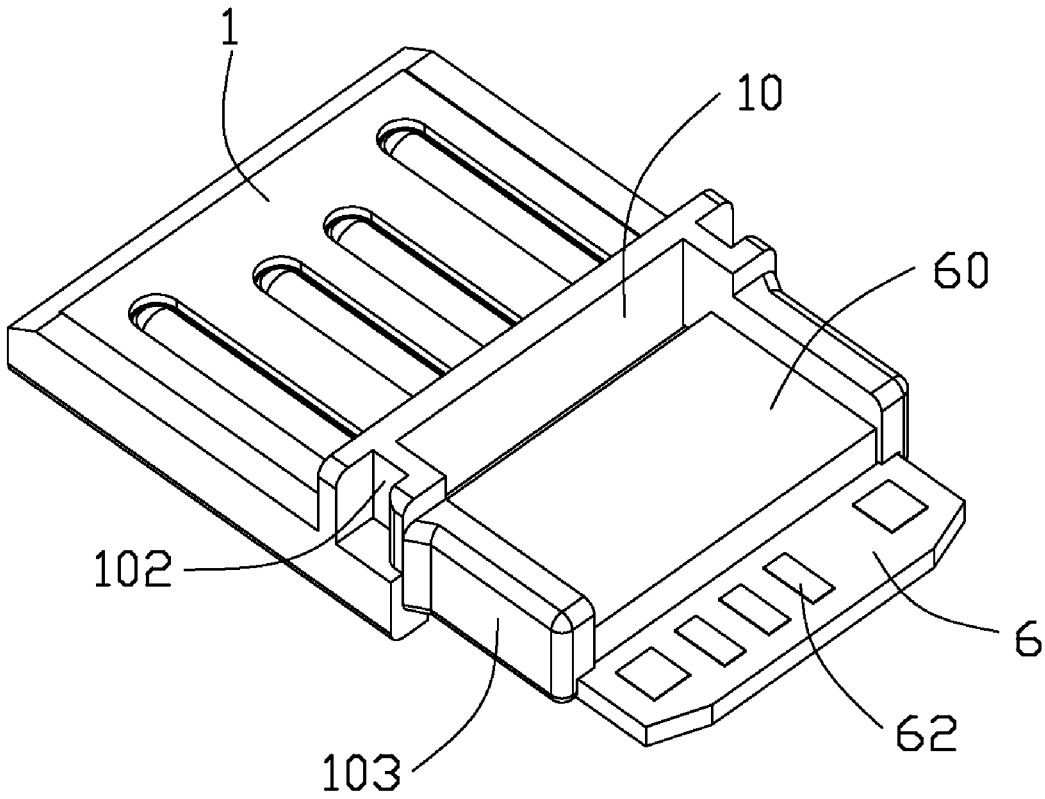
FIG. 4 is a perspective, partial assembled view of the housing, the contacts and the printed circuit board of the cable assembly of FIG. 1.
Figure 5:
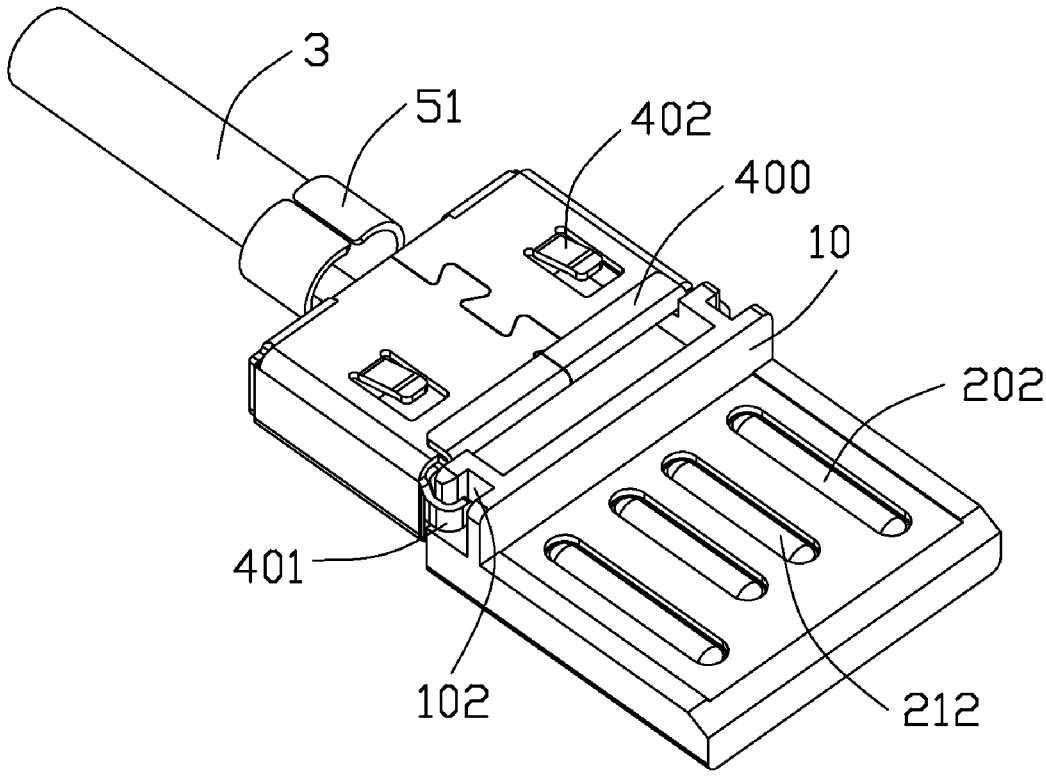
FIG. 5 is a perspective, partial assembled view of the housing, contacts, the printed circuit board, the metal shell and the cable of the cable assembly of FIG. 1.
Figure 6:
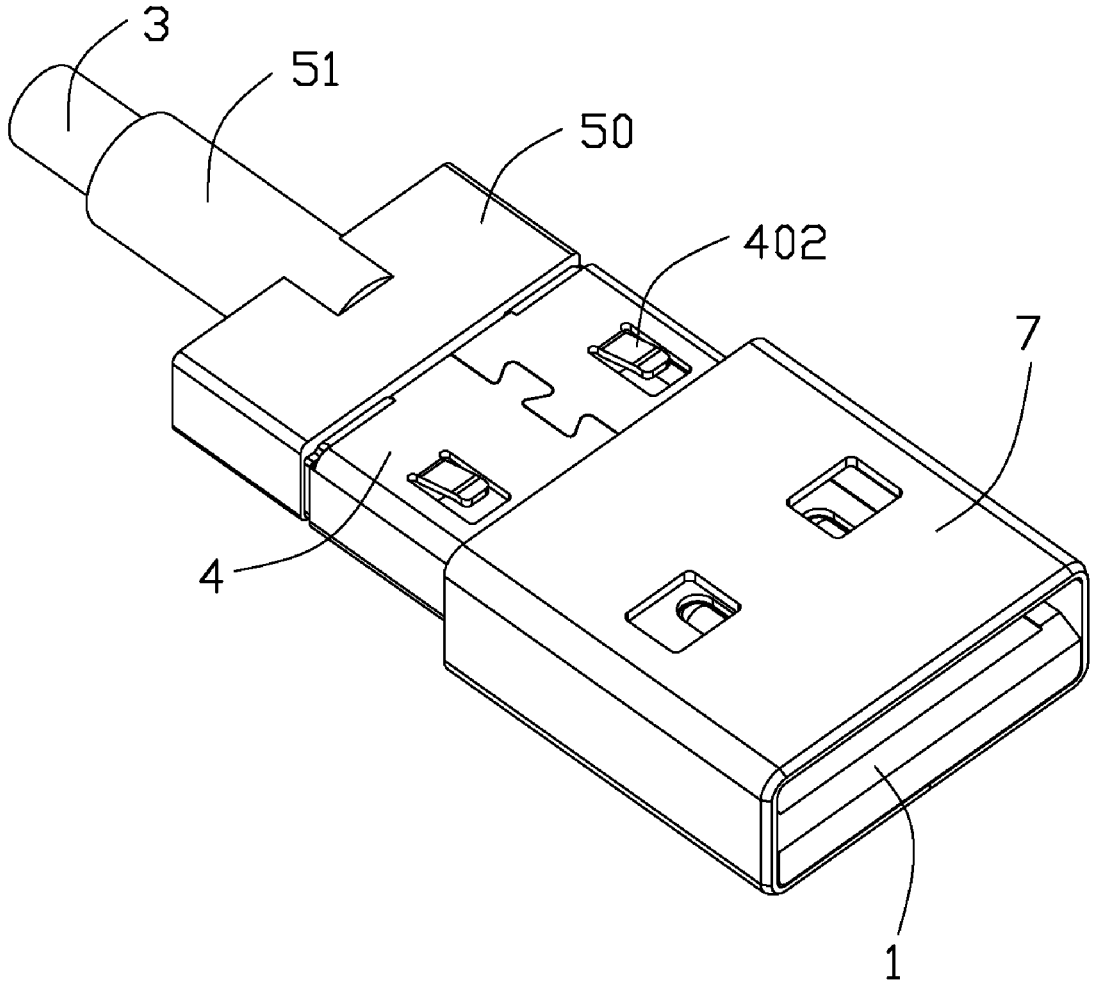
FIG. 6 is a perspective, partial assembled view of the housing, contacts, the printed circuit board, the metal shell, the cable the cable and a front cover of the cable assembly of FIG. 1.
Figure 7:
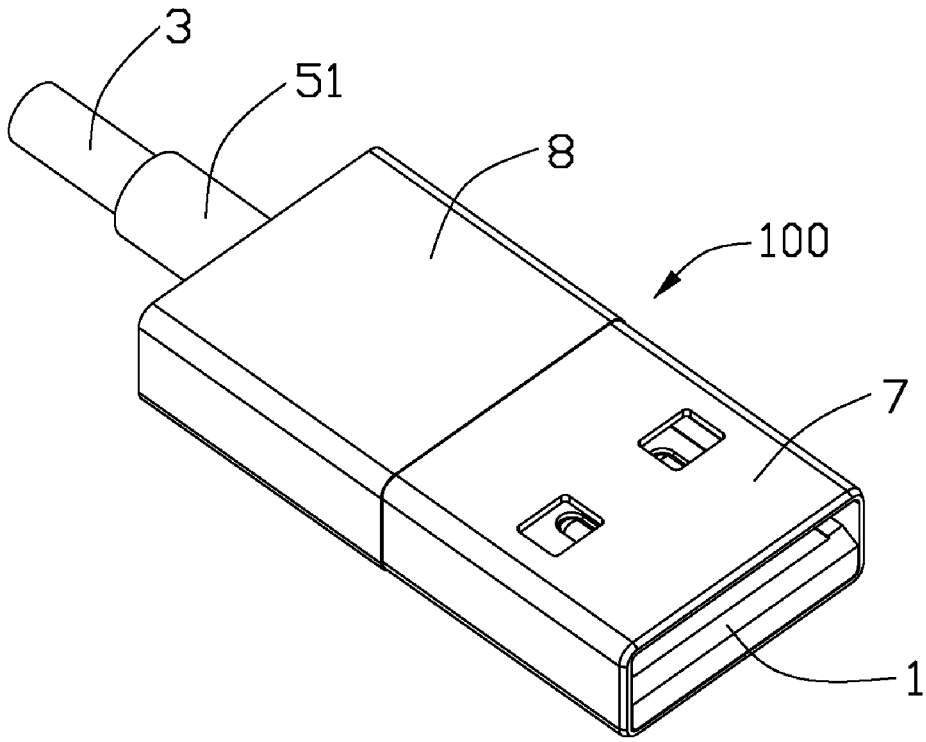
FIG. 7 is an assembly, perspective view of the cable assembly of FIG. 1.

Referring to FIGS. 1 to 3, the insulation housing 1 is substantially of rectangular shape and comprises a fastening portion 10 protruding from the rear end of the upper surface of the housing 1. The fastening portion 10 is of U-shaped configuration with a pair of L-shaped cutout 102 located on the two sides thereof and the two cutouts 102 faces toward the outside. A pair of side arms 103 rearward extends from the two sides of the rear surface of the fastening portion 10. Each of the two side arms 103 comprises a L-shape gap 1030 located on the rear end of the side arm 103 and connecting the rear surface, the lower surface and the inner surface of the side arm 103.

In this embodiment, the cable assembly 100 has four contacts 2 which includes a pair of first contacts 20 located on two sides thereof and a pair of second contacts 21 located between the two first contacts 20. The first contacts 20 comprises a first fastening piece 200 and a first tail portion 201 rearward extending from the rear end of the first fastening piece 200. The second contacts 21 comprises a second fastening piece 210 and a second tail portion 211 rearward extending from the rear end thereof. Every fastening portion 200, 210 has a protrusion portion 202, 212 locate on the middle thereof. The tails 201, 211 of the first and second contacts 20, 21 are arranged in one row.

The cable 3 comprises a plurality of wires (not shown) and an insulation cover 30 enclosing the wires.

The metal shell 4 comprises a rectangular frame 40 and a crimping portion 41 rearward extending from the rectangular frame 40, a pair of L-shaped rims 400 respectively outward and rearward extending from front ends of the upper surface and the lower surface of the rectangular frame 40, a pair of clasping portions 401 respectively frontward extending from the front surface of the two side walls of the rectangular frame 40, and two pairs of spring slices 402 respectively located on the upper surface and the lower surface of the rectangular frame 40.

The Cable assembly 100 further comprises a stress releasing portion 5. The stress releasing portion 5 is substantially of rectangular configuration and comprises a rectangular portion 50 enclosing the crimping portion 41 and a extending portion 51 rearward extending from the rectangular portion 50 and enclosing the cable 3.

The printed circuit board 6 is fixed between the two side arms 103 and inserted into the gaps 1030 of the side arms 103. The printed circuit board 6 comprises a capacitance 60 attached on the upper surface thereof, a plurality of first golden fingers 61 located on the front end of the lower surface of the printed circuit board 6 in a row and connected to the tails of the first contacts 20 and the second contacts 21, and a plurality of second golden fingers 62 located behind the capacitance 60 on the upper surface of the printed circuit board in a row and connected to the wires of the cable 3.

The front cover 7 encloses the insulation housing 1 and the rear cover 8 encloses the metal shell 4 and the stress releasing portion 5. The front cover 7 is made of metal and the rear cover 8 is made of insulative material. Two pairs of depressed portions 80 are formed on the inner surfaces of the upper and lower walls to correspond to the spring slices 402.

Referencing to FIGS. 1 to 7, in assembly, firstly, the insulation housing 1 is molded to fill and enclosing the first and second contacts 20, 21 with mating portions of these contacts being exposed to be connected to the outside of the insulation housing 1. At the same time, the tails 201, 211 of the contacts 20, 21 are exposed out the rear surface of the insulation housing 1 and located between the two side arms 103. Secondly, the printed circuit board 6 is assembled between the two side arms 103 and the tails 201, 211 of the contacts 20, 21 are soldered on the first golden fingers 61 of the printed circuit board 6. Thirdly, the wires of the cable 3 are soldered on the second golden fingers 62 of the printed circuit board 6. The metal shell 4 is assembled on the housing 1 with the metal shell 4 being located behind the fastening portion 10 and the clasping portions 401 being respectively inserted into their corresponding cutouts 102. At the same time, the crimping portion 41 catches the cable 3. Fourthly, the stress releasing portion 5 is molded to cover the crimping portion 41 and the cable 3. Fifthly, the front cover 7 covers a part of the housing 1 and is attached to the L-shaped rim 400. Lastly, the rear cover 8 covers the metal shell 4 and the stress releasing portion 5. In this embodiment, the structure that the metal shell 4 is fastened on the rear surface of the insulation housing 1 and the front cover 7 and the rear cover 8 respectively encloses the insulation housing 1 and the metal shell 4 can reduce the height of the cable assembly 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly, comprising:

a plurality of contacts;

an insulation housing molded outside the contacts and comprising a fastening portion protruding from a rear end of an upper surface of the housing, and a pair of side arms rearward extending from the two sides of a rear surface of the fastening portion; and a metal shell assembled on the insulation housing and located behind the fastening portion; wherein said fastening portion is substantially of U-shaped configuration with a pair of L-shaped cutout located on the two sides thereof and the two cutouts faces toward the outside, said metal shell comprises a pair of clasping portions respectively frontward extending from the front surface of two side walls of the rectangular frame, and the clasping portions are respectively inserted into their corresponding cutouts, wherein said metal shell further comprises a rectangular frame and a pair of L-shaped rims respectively outward and rearward extending from front ends of an upper surface and a lower surface of the rectangular frame, further comprising a front cover enclosing a part of the housing and attached to the L-shaped rim, further comprising a stress releasing portion, and a rear cover enclosing the metal shell and the stress releasing portion, wherein said stress releasing portion is substantially of rectangular configuration and comprises a rectangular portion enclosing the crimping portion and a extending portion rearward extending from the rectangular portion and enclosing the cable.

2. The cable assembly as claimed in claim 1, wherein said metal shell further comprises a pair of clasping portions respectively frontward extending from an front surface of two side walls of the rectangular frame, and two pairs of spring slices respectively located on the upper surface and the lower surface of the rectangular frame.

3. The cable assembly as claimed in claim 2, wherein said rear cover further comprises two pairs of depressed portions formed on the inner surfaces of upper and lower walls thereof to correspond to the spring slices.

4. A cable assembly, comprising:

a plurality of contacts each having a mating surface;

a insulation housing molded to fill and enclosing the contacts with mating portions of these contacts being exposed to be connected to outside of the insulation housing;

a printed circuit board electrically connected to the contacts;

a front cover covering the housing;

a rear cover located behind the front cover; and a metal shell assembled on the insulation housing and received in the rear cover; wherein the metal shell has a cross-section area is smaller than that of the front cover, wherein said metal shell further comprises a rectangular frame and a pair of L-shaped rims respectively outward and rearward extending from front ends of an upper surface and a lower surface of the rectangular frame, further comprising a stress releasing portion, and a rear cover enclosing the metal shell and the stress releasing portion, wherein said stress releasing portion is substantially of rectangular configuration and comprises a rectangular portion enclosing the crimping portion and a extending portion rearward extending from the rectangular portion and enclosing the cable, wherein said metal shell further comprises a pair of clasping portions respectively frontward extending from an front surface of two side walls of the rectangular frame, and two pairs of spring slices respectively located on the upper surface and the lower surface of the rectangular frame.

5. The cable assembly as claimed in claim 4, wherein the rear cover is made of insulation material and the front cover has surfaces respectively arranged in a plane with their corresponding surfaces of the rear cover.

6. The cable assembly as claimed in claim 5, wherein the insulation housing comprises a fastening portion protruding from the rear end of the upper surface of the housing.

7. The cable assembly as claimed in claim 6, wherein the fastening portion is substantially of U-shaped configuration with a pair of L-shaped cutout located on two sides thereof and the two cutouts faces toward the outside.

8. The cable assembly as claimed in claim 7, wherein the insulation housing comprises a pair of side arms rearward extending from two sides of the rear surface of the fastening portion.

9. The cable assembly as claimed in claim 8, wherein each of the two side arms comprises a L-shape gap located on a rear end of the side arm and connecting a rear surface, a lower surface and an inner surface of the side arm.

10. A cable connector assembly comprising:

an insulative housing with a plurality of terminals embedded therein with contacting sections exposed upon a mating face of the mating tongue of the housing;

a printed circuit board located behind the mating tongue and defining opposite surfaces thereof, on one of which solder tails of the terminals are mounted;

a front metallic shell enclosing the mating tongue with a mating cavity around the mating face in a vertical direction;

a rear metallic shell assembled to a rear section of the housing and essentially behind the front metallic shell; and an insulative cover overmolded upon the rear metallic shell with thereof a contour essentially coplanar with the front metallic shell circumferentially, further including a cable including a plurality of wires mechanically and electrically connected to the other surface of the printed circuit board on which a capacitor is mounted, wherein a rear section of the front metallic shell encloses a front section of the rear metallic shell and welded thereto for fastening the front metallic shell and the rear metallic shell together, the housing including a fastening portion being of U-shaped configuration with a pair of cutout located on two opposite sides thereof and the two cutouts facing outwardly; a pair of clasping portions extending forwardly from two opposite sides of a front region of the rear metallic shell and received in the corresponding pair of cutouts, respectively, to prevent relative movement between the housing and the rear shell in a front-to-back direction perpendicular to the vertical direction.

* * * * *